US007566189B2

(12) United States Patent
Simmons et al.

(10) Patent No.: US 7,566,189 B2
(45) Date of Patent: Jul. 28, 2009

(54) MINE ROOF BOLT WITH RESIN CONTROL SURFACE

(75) Inventors: Walter J. Simmons, Martinsburg, WV (US); W. Neal Simmons, Durham, NC (US); John G. Oldsen, Butler, PA (US)

(73) Assignee: Jennmar Corporation, Pittsburgh, PA (US)

( * ) Notice: Subject to any disclaimer, the term of this patent is extended or adjusted under 35 U.S.C. 154(b) by 20 days.

(21) Appl. No.: 11/788,386

(22) Filed: Apr. 19, 2007

(65) Prior Publication Data

US 2008/0260471 A1 Oct. 23, 2008

(51) Int. Cl.
*E21D 21/00* (2006.01)

(52) U.S. Cl. ..... 405/259.6; 405/259.5; 405/259.1; 405/288

(58) Field of Classification Search ..... 405/259.1, 405/259.5, 259.6, 302.1, 288
See application file for complete search history.

(56) References Cited

U.S. PATENT DOCUMENTS

| | | | | |
|---|---|---|---|---|
| 3,805,533 | A | 4/1974 | Askey et al. | |
| 4,302,131 | A | 11/1981 | Brown | |
| 4,419,805 | A | 12/1983 | Calandra, Jr. | |
| 4,564,315 | A | 1/1986 | Rozanc | |
| 4,664,555 | A | 5/1987 | Herbst | |
| 4,865,489 | A | 9/1989 | Stankus et al. | |
| 5,064,311 | A | 11/1991 | Giroux et al. | |
| 5,064,312 | A | 11/1991 | Calandra, Jr. et al. | |
| 5,152,649 | A | 10/1992 | Popp | |
| 5,181,800 | A | 1/1993 | Stankus et al. | |
| 5,244,314 | A | 9/1993 | Calandra et al. | |
| 5,584,608 | A | 12/1996 | Gillespie | |
| 5,624,212 | A | 4/1997 | Gillespie | |
| 7,073,982 | B2 | 7/2006 | Stankus et al. | |
| 7,296,950 | B1 * | 11/2007 | Stankus et al. | 405/259.6 |
| 2005/0134104 | A1 | 6/2005 | Simmons et al. | |
| 2006/0078391 | A1 | 4/2006 | Stankus et al. | |

FOREIGN PATENT DOCUMENTS

| | | |
|---|---|---|
| DE | 10100715 | 1/2008 |
| EP | 0196451 | 10/1986 |
| GB | 1 524 524 | 9/1978 |
| GB | 2004967 | 4/1979 |

* cited by examiner

*Primary Examiner*—Frederick L Lagman
(74) *Attorney, Agent, or Firm*—The Webb Law Firm

(57) ABSTRACT

A resin bonded mine roof bolt having an elongated rod with a first end, a second end, and a resin control surface positioned on the rod between the rod first and second ends. The resin control surface has a channel extending along the length of the bolt for distributing resin and interrupted spiral threads for mixing resin. When installed in a mine roof bore hole with curable resin, the resin control surface mixes the resin and partially fills the bore hole to minimize the amount of resin needed to anchor the bolt.

20 Claims, 6 Drawing Sheets

MINE ROOF BOLT WITH RESIN CONTROL SURFACE

BACKGROUND OF THE INVENTION

1. Field of the Invention

The present invention relates to a mine roof bolt anchored in a bore hole by resin bonding and, more particularly, to a mine roof bolt bearing a resin control layer that exerts a compressive force on resin within a bore hole.

2. Description of Related Art

The roof of a mine conventionally is supported by tensioning the roof with 4 to 6 feet long steel bolts inserted into bore holes drilled in the mine roof that reinforce the unsupported rock formation above the mine roof. The end of the mine roof bolt may be anchored mechanically to the rock formation by engagement of an expansion assembly on the end of the mine roof bolt with the rock formation. Alternatively, the mine roof bolt may be adhesively bonded to the rock formation with a resin bonding material inserted into the bore hole. A combination of mechanical anchoring and resin bonding may be employed by using both an expansion assembly and resin bonding material.

When resin bonding material is used, it penetrates the surrounding rock formation to adhesively unite the rock strata and to firmly hold the roof bolt within the bore hole. Resin is typically inserted into the mine roof bore hole in the form of a two-component plastic cartridge having one component containing a curable resin composition and another component containing a curing agent or catalyst. The two-component resin cartridge is inserted into the blind end of the bore hole, and the mine roof bolt is inserted into the bore hole such that the end of the mine roof bolt ruptures the two-component resin cartridge. Upon rotation of the mine roof bolt about its longitudinal axis, the compartments within the resin cartridge are shredded and the components are mixed. The resin mixture fills the annular area between the bore hole wall and the shaft of the mine roof bolt. The mixed resin cures and binds the mine roof bolt to the surrounding rock.

The typical diameter of a mine roof bore hole is one inch. Mine roof bolts anchored with resin bonding are often ¾ inch in diameter, and more recently, ⅝ inch in diameter. The mine roof bolt is generally centered within the bore hole creating a circular annulus that becomes filled with bonding resin. The larger diameter bolts (¾ inch) offer performance advantages over ⅝ inch bolts in that the annulus provided between the bore hole wall and a ¾ inch bolt is smaller than that of smaller diameter bolts. A smaller annulus provided between the bolt and the bore hole wall improves mixing of the resin and catalyst in the annulus. In addition, when the resin cartridge is shredded upon insertion of the mine roof bolt and rotation thereof in an annulus larger than ⅛ inch (as for mine roof bolts having less than ¾ inch diameter installed in one inch bore holes), the shredded cartridge can interfere with the resin and catalyst mixing. Poor mixing results in an inferior cured resin and results in poor bond strength between the bolt and bore hole wall. A phenomenon of "glove fingering" occurs when the plastic film that forms the cartridge lodges in the bore hole proximate the surrounding rock, thereby interrupting the mechanical interlock desired between the resin and bore hole wall. This phenomenon can also manifest itself in the bolt inserting longitudinally through only one compartment of the two-compartment package. When this occurs, sections of the uncured resin and unmixed catalyst are evident in the bore hole, thus affecting the overall bond strength of the bolt resin system to the surrounding rock. In addition, the larger annulus created by using a ⅝ inch bolt in a one-inch bore hole requires more resin to bond the bolt to the rock than does a larger diameter bolt, thereby adding to the cost of installing a smaller diameter bolt. While one solution might be to proportionally reduce the size of the bore hole to less than one inch, this is not practicable. The mine roof drilling equipment already in use is conventionally produced for drilling one-inch bore holes. Moreover, there are significant technical difficulties in drilling small diameter bore holes in mine roofs.

Despite these drawbacks of using mine roof bolts having a diameter of less than ¾ inch, the popularity of smaller diameter mine roof bolts is increasing. A ⅝ inch bolt is more lightweight and easier to use than a ¾ inch bolt and can be produced at lower cost.

A mine roof bolt that overcomes the need for extra resin and avoiding the glove fingering problem of smaller diameter bolts installed in one-inch bore holes is disclosed in U.S. Patent Application Publication No. 2005/0134104. The bolt includes an elongated rod that forms the main structure of the mine roof bolt. A portion of the rod between a drive head and the end of the bolt is coated with a layer of material having a lower specific gravity than the rod, such as a polymer. The polymeric coating layer includes interrupted raised threads that help with mixing of resin in the mine roof bore hole. The coating on the mine roof bolt also helps to fill a portion of the annulus at a minimal increase in weight to the bolt, thereby minimizing the amount of resin that is required for bonding the bolt to rock strata. This coated mine roof bolt can be produced from a ⅝ inch metal rod with a polymeric coating layer about 1/16 inch thick.

One problem with the coated mine roof bolt is in the distribution of resin along the length of the bolt prior to curing. Conventional resin systems typically cure in 5 seconds to 2 minutes and are manufactured with design parameters specifically for larger annulus bolts. Once mixing is complete and curing begins, the resin should be distributed along the length of the bolt to maximize interlock between the bolt and the surrounding rock. In some instances, the resin may not be distributed as needed along the bolt before curing begins, due to deficiencies in the flow parameters of the resin, the mechanical limitations of the installation equipment, and the insertion strength of the bolt.

In addition, the portion of the coating in between the spiral threads is generally smooth. These smooth surfaces provide only minimal structure to engage with the cured resin.

Accordingly, a need remains for a resin-bonded mine roof bolt where the resin mixing and distribution is controlled by the bolt and that is particularly suited as a small diameter mine roof bolt.

SUMMARY OF THE INVENTION

This need is met by the mine roof bolt of the present invention that includes an elongated rod having a first end, a second end and a resin control surface located on the rod at a position between the first and second ends. The resin control surface defines a channel extending between ends of the resin control surface in a direction generally parallel to the longitudinal axis of the rod. In one embodiment, the resin control surface is a layer positioned on the rod with the channel defined in the layer. The rod may be metallic, and the layer may be polymeric. Alternatively, the rod and resin control surface may be a unitary structure.

In another embodiment, the resin control surface includes a plurality of raised, interrupted threads, with the threads bearing ridges. The portions of the resin control surface in between the threads may also include ridges. The ends of the threads may be aligned longitudinally along the rod with the channel spaced apart from the aligned thread ends.

When the mine roof bolt of the present invention is installed in the mine roof bore hole, a frangible curable resin cartridge is inserted into the bore hole. The mine roof bolt is inserted into the bore hole and ruptures the resin cartridge. The mine roof bolt is rotated about its longitudinal axis such that the resin control layer contributes to mixing of the contents of the resin cartridge and to distributing resin along the bolt through the channel. The resin control layer also compresses the resin between the mine roof bolt and the bore hole wall. The ridges on the interrupted threads and/or portion of the resin control surface therebetween provide enhanced surface area for interlocking of resin with the bolt and surrounding rock. In addition, the spiral threads urge the resin toward the first end upon rotation of the mine roof bolt.

The mine roof bolt of the present invention may be produced by providing an elongated rod and applying a resin control surface to the rod intermediate a first and second end of the rod. A drive head or drive nut is attached to the second end of the rod. The resin control surface may be a polymeric layer and may be applied to the rod by injection molding, or the resin control surface may be unitary with the rod and is formed thereon via casting or machining of the rod.

DETAILED DESCRIPTION OF THE INVENTION

Figure 1:
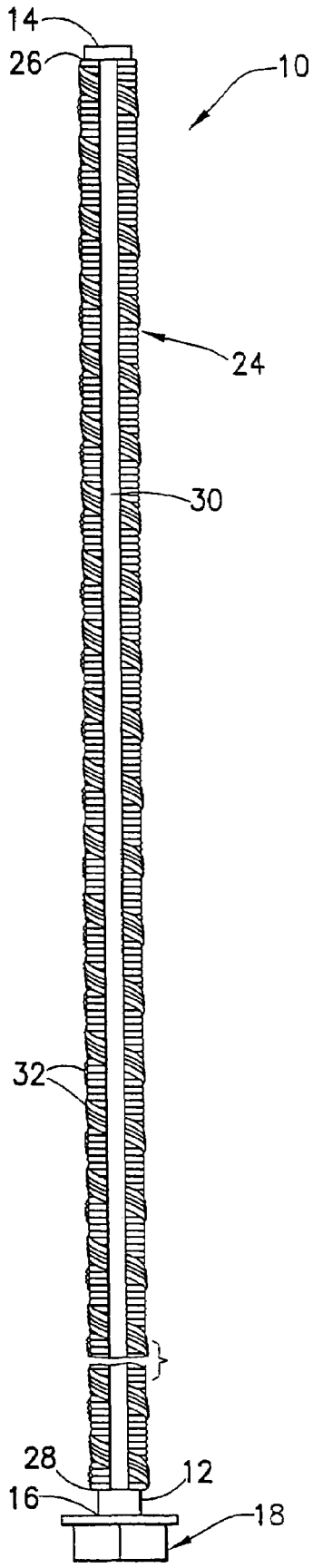
FIG. 1 is a side elevational view of a mine roof bolt of the present invention having a resin control surface layer.
Figure 2:
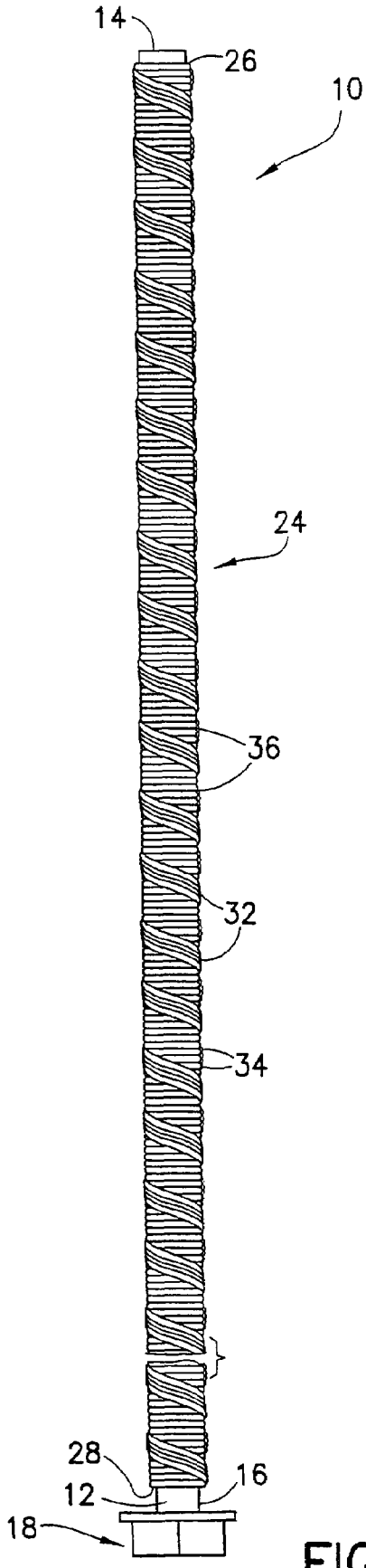
FIG. 2 is a side elevational view of the mine roof bolt of FIG. 1, from an opposing side thereof.

A complete understanding of the present invention will be obtained from the following description taken in connection with the accompanying drawing figures, wherein like reference characters identify like parts throughout.

For the purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume alternative variations and step sequences, except where expressly specified to the contrary. It is also to be understood that the specific devices and processes illustrated in the attached drawings and described in the following specification are exemplary embodiments of the invention. Specific dimensions and other physical characteristics related to the embodiments disclosed herein are not considered to be limiting.

Referring to FIGS. 1-4, there is illustrated a mine roof bolt 10 for securing in a bore hole drilled in a rock formation (not shown) to support the rock formation that overlies an underground excavation such as a mine passageway or the like. The bore hole is drilled to a pre-selected depth into the rock formation as determined by the load bearing properties to be provided by the mine roof bolt 10.

Figure 3:
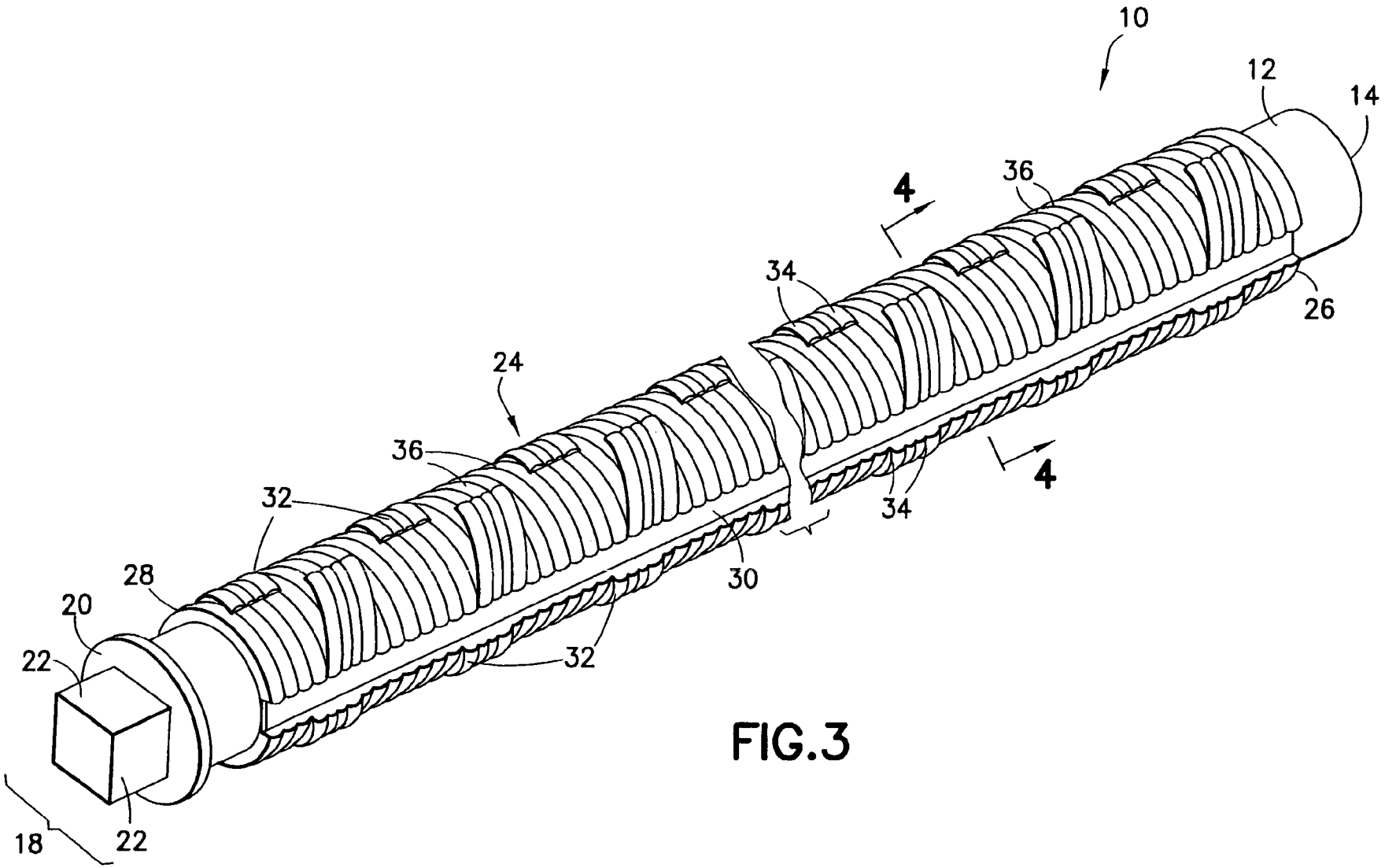
FIG. 3 is a perspective view of the mine roof bolt of FIG. 1.
Figure 4:
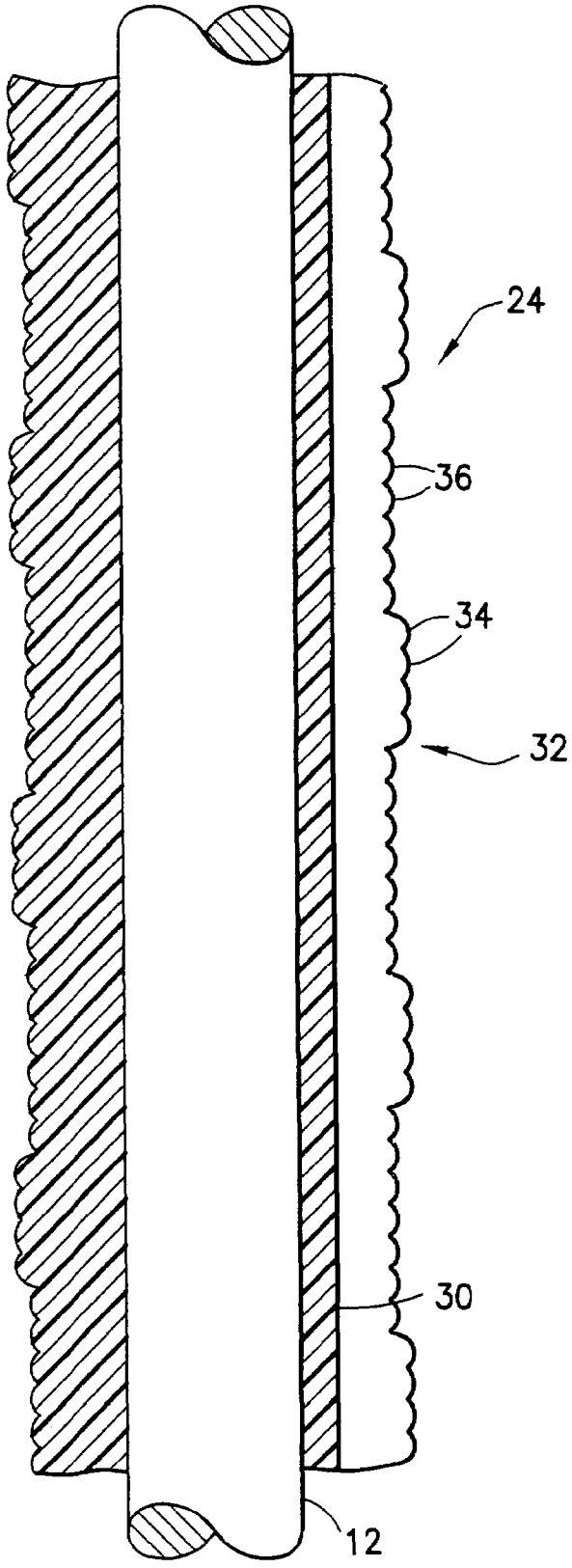
FIG. 4 is a cross-sectional view of a portion of the mine roof bolt shown in FIG. 3, taken along line 4-4.

The bolt 10 includes an elongated rod 12, typically being metallic, having a first end 14 for positioning in the blind end of a bore hole and a second end 16. A drive head 18 is attached to second end 16 for extending into the mine passageway from the open end of the bore hole. In one embodiment, as shown in FIG. 3, the drive head 18 includes a shoulder 20 and a plurality of drive faces 22. The rod 12 and drive head 18 typically are integrally produced from steel or other metals. Drive head 18 shown in the drawings is only one example of a drive head. Other suitable drive heads include internally threaded nuts that are threaded onto the rod second end 16, which may further incorporate a stop mechanism for post-curing tensioning of the bolt 10.

A portion of the elongated rod 12 between the first and second ends 14, 16 includes a resin control surface 24. In one embodiment, the resin control surface 24 is a separate layer of material provided on the rod 12. This is not meant to be limiting as the resin control surface 24 may be integral with the rod 12, such as by having been produced thereon via casting or machining or the like. The elongated rod 12 may be a smooth rod or a textured rod such as rebar, with a smooth rod being shown in the drawings herein. In one embodiment of the invention, the resin control surface 24 extends between a first surface end 26 at a position adjacent the rod first end 14, such as about one inch from the rod first end 14, and a second surface end 28 positioned adjacent the rod second end 16, such as within one to two inches of the rod second end 16. Other lengths of the resin control surface 24 may be selected relative to the length of the bolt 10, depending on the roof anchoring needs.

Figure 5:
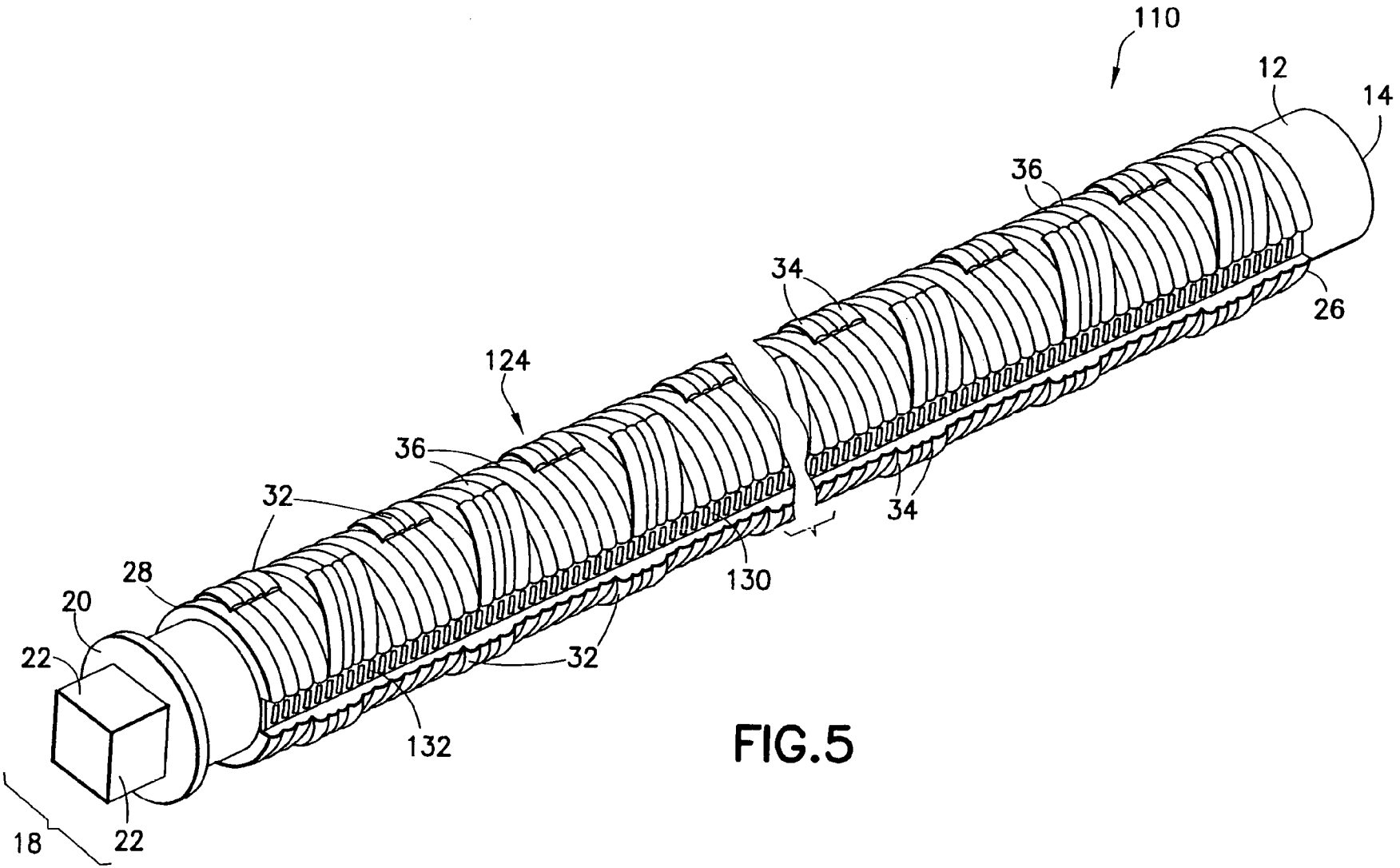
FIG. 5 is a perspective view of another mine roof bolt of the present invention.

The resin control surface 24 defines a channel 30 extending between first and second surface ends 26, 28. As shown in FIG. 3, channel 30 is open at surface ends 26, 28, to allow curable resin to flow into and out from the channel 30. In one embodiment, the width of the channel 30 is about 2 to 20% of the circumference of the resin control surface 24. The resin control surface 24 may further include a plurality of raised spiral threads 32, each spiral thread 32 being discontinuous with an adjacent thread 32. The spiral threads 32 may be textured with ribs or ridges 34 as shown (FIG. 4), or the threads 32 may be smooth. Four ridges 34 are shown on each thread 32, but this is not meant to be limiting as fewer or more ridges 34 may be included thereon. In addition, portions of the resin control surface 24 between spiral threads 32 may also be textured, such as with ribs or ridges 36. Ridges 36 are shown as being generally disposed circumferentially around resin control surface 24, but this is not meant to be limiting as other patterns or features of ridges 36 are encompassed by the present invention. The spiral threads 32 of the resin control surface 24 urge resin upwardly into the bore hole upon rotation of the bolt 10 during mixing of resin. The ridges 34 and 36 further assist in mixing and distributing the resin around the mine roof bolt 10 and provide surfaces for mechanical interaction with cured resin, thereby enhancing the interlock between the bolt 10 and surrounding rock. The channel 30 shown in FIG. 3 has smooth surfaces. However, this is not meant to be limiting. In another embodiment, as shown in FIG. 5, bolt 110 includes resin control surface 124 defining channel 130. Channel 130 includes ridges 132 or other features providing texture thereto. Such features also assist in mixing resin and provide additional surfaces for mechanical interaction with cured resin. All references to bolt 10 hereinafter are applicable to bolt 110.

The mine roof bolt 10 of the present invention may be produced by coating the elongated rod 12 with a flowable polymer so that the coating has a thickness such as about at least 1 mm. The polymer is allowed to solidify on the elongated rod 12 and texturing is applied to the exterior of the polymer to form the channel 30, spiral threads 32 and ridges 34, 36. The coating step may be performed by dip coating, injection molding and/or hot forging of the polymer resulting in an outer layer of a low density hard coating of the resin control surface 24 on an inner portion of higher density material (e.g., steel) of the elongated rod 12. When the resin control surface 24 is formed from a polymer, the low density hard coating that is applied increases the overall diameter of a portion of the bolt 10 with a minimal increase in weight. Hence, while realizing the weight advantages of polymers as compared to metals used in an elongated rod 12, such a composite bolt 10 can be advantageously sized to provide improved mixing of resin by creating a smaller annulus between the bolt in the location of the resin control surface 24 and the rock surrounding a bore hole. Likewise, with reduced annulus dimensions, less resin is required for bonding the bolt 10 within a bore hole with concomitant reduction in the size and quantity of shredded resin packaging film that remains after mixing.

In one embodiment of the invention, the elongated rod 12 is a smooth rod and the polymer coating is produced by molding to create the channel 30, spiral threads 32 and ridges 34, 36. Typically, the thickness of the coating is sufficient to minimize the annulus between the resin compression layer and the bore hole wall at less than ⅛ inch or less than 1/16 inch. This reduces the overall weight of a similar sized mine roof bolt, produced from a higher density material (e.g., steel), particularly if the coating is a polymer of low density, such as about 2.0 g/ml or less.

In accordance with the present invention, the mine roof bolt 10 may be installed in a mine roof to provide support to a rock formation. In one embodiment of the method of supporting a mine roof, the mine roof bolt 10 is installed by inserting a frangible resin cartridge into a bore hole and inserting the mine roof bolt 10 into the bore hole. The drive head 18 of mine roof bolt 10 extends out of the bore hole. A post resin cure tensioning drive nut may be threaded onto the second end 16 of rod 12 until the tensioning drive nut cannot be advanced further along second end 16 when the tensioning drive nut abuts a stop or the mine roof itself, thereby inducing tension in the bolt. Continued rotation of the tensioning drive nut imparts rotation to the bolt and mixing of the resin. When the rod first end 14 contacts a resin cartridge in a bore hole, the cartridge ruptures releasing a curable resin. The mine roof bolt 10 is rotated about its longitudinal axis so that the resin control layer 24 and any exposed portion of elongated rod 12 mixes the contents of the resin cartridge. Resin released from the cartridge flows down along the bolt, particularly via channel 30, which enhances the rate at which resin is distributed along the length of the bolt 10. Channel 30 allows resin to flow directly down the length of the bolt. In this manner, resin is rapidly distributed along the length of the bolt before the resin cures. In addition, the resin control surface 24 compresses the resin between the exterior of the mine roof bolt 10 and the bore hole wall.

The resin control surface 24 serves several functions during installation of the mine roof bolt 10 and after it is installed in a mine roof. As the bolt 10 is rotated about its longitudinal axis, the spiral threads 32 on the resin control surface 24 urge resin upwardly toward the blind end of a bore hole, while the channel 30 allows for resin to be distributed along the length of the bolt. In this manner, these two features of the resin control surface 24 (threads 32 and channel 30) together ensure distribution of resin along the bolt 10. Distribution of resin along the length of the bolt ensures good bonding between the mine roof bolt 10 and the surrounding rock. Sufficient resin is required in the annulus between the mine roof bolt 10 and the bore hole wall to completely fill the annulus and allow for some of the resin to fill cracks and crevices in the rock to enhance the interlock between the rock and the mine roof bolt 10.

Figure 6:
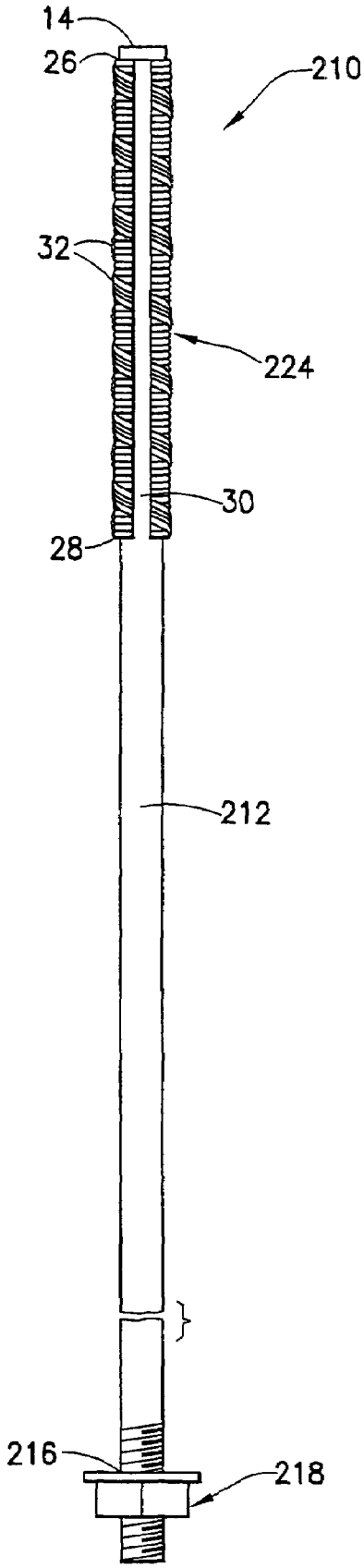
FIG. 6 is a side elevational view of another mine roof bolt of the present invention.

The resin control surface 24 also serves to mix resin. The spiral threads 32 and the ridges 34, 36 provide mixing surfaces to enhance mixing of the curable resin. FIG. 6 depicts another embodiment of the present invention. Mine roof bolt 210 is similar to bolts 10, 110, except that second surface end 28 of resin control surface 224 is positioned intermediate first end 14 and second end 216 of rod 212. Second end 216 of rod 212 is threaded to accept a tensioning nut 218. Bolt 210 is installed in a mine roof similar to bolts 10, 110 and may be tensioned after resin curing by threading nut 218 toward the first end 14.

The length of resin control surface 224 may be selected based on the anchoring needs. Bolt 210 is suitable for use with less resin than bolts 10, 110 and may function as a point anchor. In particular, bolt 210 may be installed in a bore hole with curable resin where the resin is provided primarily in the annulus between resin control surface 224 and the bore hole wall. A resin retaining ring (not shown), such as described in U.S. Pat. No. 4,865,489 or 5,181,800 both incorporated herein by reference, may be provided at a position intermediate the rod first and second ends 14, 16 (such as adjacent the second surface end 28) to retain resin in the annulus surrounding the resin control surface 224. The resin retaining ring may be incorporated with the resin control surface 224, such as by molding a resin retaining ring with surface 224 to produce an integrally formed resin retaining ring.

While the present invention has been described with reference to particular embodiments of a mine roof bolt and methods associated therewith, those skilled in the art may make modifications and alterations to the present invention without departing from the spirit and scope of the invention. Accordingly, the foregoing detailed description is intended to be illustrative rather than restrictive. The invention is defined by the appended claims, and all changes to the invention that fall within the meaning and the range of equivalency of the claims are embraced within their scope.

The invention claimed is:

1. A mine roof bolt comprising:

an elongated rod having a first rod end and a second rod end and comprising a resin control surface located on said rod at a position between said first and second rod ends, said resin control surface having a first surface end and a second surface end, the surface defining a channel extending between said first and second surface ends.

2. The mine roof bolt of claim 1, wherein said channel extends in a direction parallel to a longitudinal axis of said rod.

3. The mine roof bolt of claim 1, wherein said resin control surface comprises a layer positioned on said rod, said channel being defined in said layer.

4. The mine roof bolt of claim 3, wherein said layer further includes a plurality of interrupted threads.

5. The mine roof bolt of claim 4, wherein said threads are ribbed.

6. The mine roof bolt of claim 4, wherein said layer between said threads is ribbed.

7. The mine roof bolt of claim 1, wherein the surface within said channel is textured.

8. The mine roof bolt of claim 4, wherein said threads are raised.

9. The mine roof bolt of claim 1, wherein said resin control surface extends from a position adjacent said first rod end to a position adjacent said second rod end.

10. The mine roof bolt of claim 1, wherein said resin control surface extends from a position adjacent said first rod end to a position intermediate said first and second rod ends.

11. The mine roof bolt of claim 1, further comprising a drive head positioned on said second rod end.

12. The mine roof bolt of claim 3, wherein said layer comprises a polymeric material.

13. A mine roof bolt comprising:

an elongated rod having a first rod end and a second rod end; and a coating positioned on said rod, said coating including a plurality of circumferential ridges and a plurality of interrupted spiral threads, each said ridge extending around a circumference of the rod.

14. The mine roof bolt of claim 13, wherein said coating defines a longitudinal channel extending between ends of said coating.

15. The mine roof bolt of claim 14, wherein ends of said spiral threads are aligned longitudinally along said rod.

16. The mine roof bolt of claim 15, wherein said channel is spaced apart from said aligned thread ends.

17. A method of installing a mine roof bolt in a bore hole, comprising:

inserting a frangible curable resin cartridge into a bore hole;

inserting a mine roof bolt into the bore hole, the mine roof bolt comprising an elongated rod having a first end, a second end and a resin control surface located on said rod, the resin control surface defining a longitudinally extending channel;

rupturing the resin cartridge; and rotating the mine roof bolt, whereby the contents of the resin cartridge mix and flow through said channel.

18. The method of claim 17, wherein the resin control surface further includes a plurality of interrupted spiral threads, the bolt being rotated in a direction that urges the resin toward the first end.

19. The method of claim 18, wherein the threads are raised and include ribs.

20. The method of claim 17, wherein the resin control surface extends from the first end to a position intermediate the first and second ends, and a tensioning nut is provided on the second end, the method further comprising tensioning the bolt after the resin at least partially cures by moving the tensioning nut toward the first end.

* * * * *